US007721817B2

(12) United States Patent
McGee et al.

(10) Patent No.: US 7,721,817 B2
(45) Date of Patent: May 25, 2010

(54) FASTENER DRIVING DEVICE WITH ADJUSTABLE SHOE

(75) Inventors: David M. McGee, Attleboro, MA (US); Prudencio S. Canlas, Jr., North Kingstown, RI (US); William J. Palm, Newtonville, MA (US); Laurence W. Tremaine, West Warwick, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 412 days.

(21) Appl. No.: 11/396,905

(22) Filed: Apr. 4, 2006

(65) Prior Publication Data

US 2006/0261124 A1 Nov. 23, 2006

Related U.S. Application Data

(60) Provisional application No. 60/681,958, filed on May 18, 2005.

(51) Int. Cl.
*B25C 1/04* (2006.01)

(52) U.S. Cl. ..... 173/37; 173/31; 227/110; 227/147; 227/148; 227/150

(58) Field of Classification Search ..... 227/110, 227/147, 148, 150; 173/31, 37
See application file for complete search history.

(56) References Cited

U.S. PATENT DOCUMENTS 2,768,376 A 10/1956 Critchley
3,012,247 A 12/1961 Sillars et al.
3,161,886 A 12/1964 Omholt
3,281,046 A 10/1966 Boulay
3,360,176 A 12/1967 Gehl et al.
3,554,428 A * 1/1971 Smith ..... 227/109
3,612,380 A * 10/1971 Kuhlman ..... 227/120

(Continued)

FOREIGN PATENT DOCUMENTS

CH 603 316 8/1978

OTHER PUBLICATIONS

Besco Pneumatic Corp. 2005 Catalog, "Flooring Tools," p. 27, (2005).

(Continued)

*Primary Examiner*—Brian D Nash
(74) *Attorney, Agent, or Firm*—Pillsbury Winthrop Shaw Pittman LLP

(57) ABSTRACT

A fastener driving device includes a housing containing an engine for driving a fastener through a flooring board and into a sub-floor, a nosepiece through which fasteners are driven, a magazine for supplying a plurality of fasteners for the engine to drive, and a shoe mounted for movement relative to the nosepiece. The shoe locates the engine relative to the flooring board so that the fastener is driven into the flooring board at an angle. The shoe includes a bottom workpiece engaging surface for engaging a top surface of the flooring board, and the nosepiece includes a forward workpiece engaging surface for engaging a front surface of the flooring board. The forward surface extends a distance below the bottom surface. One of the bottom surface and the forward surface is movable with respect to the other to adjust the distance that the forward surface extends below the bottom surface.

35 Claims, 10 Drawing Sheets

U.S. PATENT DOCUMENTS

| | | | | |
|---|---|---|---|---|
| 3,670,941 | A * | 6/1972 | Grinnell et al. | 227/8 |
| 3,711,008 | A * | 1/1973 | Clifford et al. | 227/147 |
| 3,764,053 | A * | 10/1973 | Thompson | 227/111 |
| 3,864,053 | A | 2/1975 | Harwood | |
| 4,084,738 | A * | 4/1978 | Schneider | 227/7 |
| 4,196,833 | A * | 4/1980 | Haytayan | 227/8 |
| 4,204,625 | A * | 5/1980 | Glenn | 227/76 |
| 4,346,831 | A * | 8/1982 | Haytayan | 227/8 |
| 5,062,562 | A * | 11/1991 | Michael | 227/111 |
| 5,699,599 | A * | 12/1997 | Zieve | 29/34 B |
| 5,743,455 | A * | 4/1998 | Holliday | 227/142 |
| 5,868,183 | A | 2/1999 | Kozyrski et al. | |
| 6,095,392 | A * | 8/2000 | Batts et al. | 227/8 |
| 6,155,472 | A * | 12/2000 | Deziel | 227/8 |
| 6,209,770 | B1 | 4/2001 | Perra | |
| 6,269,996 | B1 | 8/2001 | McAllister | |
| 6,318,620 | B1 | 11/2001 | Anstett et al. | |
| 6,527,156 | B2 * | 3/2003 | McAllister et al. | 227/7 |
| 6,631,836 | B2 | 10/2003 | Dickhaut | |
| 6,834,789 | B1 * | 12/2004 | Dion et al. | 227/148 |
| 6,843,402 | B2 | 1/2005 | Sims et al. | |
| 7,159,747 | B1 * | 1/2007 | Tanner | 227/139 |
| 7,198,188 | B2 * | 4/2007 | Dion et al. | 227/110 |
| 7,255,256 | B2 * | 8/2007 | McGee et al. | 227/8 |
| 7,303,105 | B2 * | 12/2007 | Dion et al. | 227/147 |
| 7,344,057 | B2 * | 3/2008 | Dion et al. | 227/8 |
| 2001/0038026 | A1 * | 11/2001 | Dickhaut | 227/148 |
| 2003/0024962 | A1 | 2/2003 | Sims | |
| 2003/0080171 | A1 | 5/2003 | Sato et al. | |
| 2004/0188491 | A1 | 9/2004 | Huang | |
| 2005/0145670 | A1 | 7/2005 | Huang | |
| 2006/0124683 | A1 * | 6/2006 | Dion et al. | 227/8 |
| 2006/0261129 | A1 * | 11/2006 | McGee et al. | 227/148 |
| 2007/0017953 | A1 * | 1/2007 | Hamar | 227/8 |
| 2007/0017954 | A1 * | 1/2007 | Dion et al. | 227/148 |
| 2007/0057013 | A1 * | 3/2007 | Deziel | 227/147 |
| 2007/0257081 | A1 * | 11/2007 | Dion et al. | 227/148 |

OTHER PUBLICATIONS

International Search Report issued in PCT/US/2006/018861 dated Oct. 26, 2006.

Written Opinion of the International Searching Authority issued in PCT/US/2006/018861 dated Oct. 26, 2006.

* cited by examiner

FASTENER DRIVING DEVICE WITH ADJUSTABLE SHOE

CROSS-REFERENCE TO RELATED APPLICATIONS

The present application claims the benefit of priority from U.S. Provisional Patent Application No. 60/681,958, filed May 18, 2005 and entitled "FASTENER DRIVING DEVICE WITH ADJUSTABLE FEATURES," the entire content of which is incorporated herein by reference.

FIELD OF THE INVENTION

The present invention is generally directed to fastener driving devices. More specifically, the present invention is directed to a fastener driving device that includes an adjustable shoe for flooring applications.

DESCRIPTION OF RELATED ART

Tongue and groove type flooring is manufactured in different thicknesses. However, most flooring tools have fixed surfaces that define the placement of the fastener in the flooring board. For example, one surface is placed on top of the flooring board, and another surface is position on a front face of the flooring board, just above the tongue of the flooring board to be fastened to the sub-floor. The engine and associated drive track has already been fixed relative to the fixed surfaces of the tool such that the engine will drive the fastener into the board at a predetermined location (e.g. just above the tongue at an angle). This works well if the flooring tool is specifically designed for that thickness of board. However, if a thinner board is to be attached to the sub-floor, either a different tool should be used, or a shim should be attached to the tool, thereby moving the location of the drive track relative to the top surface of the flooring board when the tool is placed on the top surface of the flooring. Similarly, if a thicker board is to be attached to the sub-floor, a different tool should be used, or a shim, if there is one, should be removed from the tool. The use of shims may become cumbersome, because each thickness of flooring board should have its own associated shim. Because shims are physically removed from the tool, they may be misplaced. It is, therefore, desirable to have a single flooring tool that may be more easily adjusted to accommodate different sizes of flooring boards.

Conventional flooring tools include a pad that is fastened to the frame of the tool with a plurality of fasteners. The pad includes a plurality of holes through which the fasteners pass through. The holes are designed to allow the heads of the fasteners to be recessed in from the surface of the pad that contacts the flooring board. However, over time, these fasteners may become loose and work their way out of the holes. The user of the tool may not realize this until the heads of the fasteners scratch or mar the flooring board. It is, therefore, desirable to have a flooring tool that is designed so that the flooring boards are protected from such accidental damage.

BRIEF SUMMARY OF THE INVENTION

It is an aspect of the present invention to provide a fastener driving device that can be used to fasten flooring boards of different thicknesses to a sub-floor.

In an embodiment, a fastener driving device for fastening a flooring board to a sub-floor is provided. Each flooring board has a top surface, a tongue, and a front surface connecting the top surface and the tongue. The device includes a housing containing an engine for driving a fastener through the flooring board and into the sub-floor, a magazine for supplying a plurality of fasteners for the engine to drive, a handle for receiving a user's hand, and a shoe connected to the housing. The shoe is configured to locate the engine relative to the flooring board so that the fastener is driven into the flooring board at an angle. The shoe includes a bottom workpiece engaging surface for engaging the top surface of the flooring board, and a forward workpiece engaging surface for engaging the front surface of the flooring board. An exposure of the forward workpiece engaging surface is adjustable between a minimum exposure and a maximum exposure to accommodate different thicknesses of the flooring boards.

In another embodiment, a fastener driving device for fastening flooring boards to a sub-floor is provided. Each flooring board has a top surface, a tongue, and a front surface connecting the top surface and the tongue. The device includes a housing containing an engine for driving a fastener through the flooring board and into the sub-floor, a nosepiece through which fasteners are driven, a magazine for supplying a plurality of fasteners for the engine to drive, a handle for receiving a user's hand, and a shoe mounted for movement relative to said nosepiece. The shoe is configured to locate the engine relative to the flooring board so that the fastener is driven into the flooring board at an angle. The shoe includes a bottom workpiece engaging surface for engaging the top surface of the flooring board, and the nosepiece includes a forward workpiece engaging surface for engaging the front surface of the flooring board. The forward workpiece engaging surface extends a distance below the bottom workpiece engaging surface. One of the bottom workpiece engaging surface and the forward workpiece engaging surface is movable with respect to the other to adjust the distance that the forward workpiece engaging surface extends below said bottom workpiece engaging surface.

It is also an aspect of the present invention to provide a shoe for a fastener driving device that allows the fastener driving device to be used to fasten flooring boards of different thicknesses to a sub-floor.

In an embodiment, a shoe for coupling with a fastener driving device is provided. The shoe is configured to locate an engine of the fastener driving device relative to a flooring board so that a fastener is driven into the flooring board at an angle. The flooring board includes a top surface, a tongue, and a front surface that connects the top surface and the tongue. The shoe includes a bottom workpiece engaging surface for engaging the top surface of the flooring board, and a forward workpiece engaging surface for engaging the front surface of the flooring board. An exposure of the forward workpiece engaging surface is adjustable between a minimum exposure and a maximum exposure to accommodate different thicknesses of the flooring boards.

In another embodiment, a shoe for coupling with a fastener driving device is provided. The shoe is configured to locate an engine of the fastener driving device relative to a flooring board so that a fastener is driven into the flooring board at an angle. The flooring board includes a top surface, a tongue, and a front surface that connects the top surface and the tongue. The shoe includes a bottom workpiece engaging surface for engaging the top surface of the flooring board, and a forward workpiece engaging surface for engaging the front surface of the flooring board. The forward workpiece engaging surface extends a distance below the bottom workpiece engaging surface. One of the bottom workpiece engaging surface and the forward workpiece engaging surface is movable with respect to the other to adjust the distance that the forward workpiece engaging surface extends below the bottom workpiece engaging surface.

In an embodiment, an adjustment mechanism includes a bottom workpiece engaging surface for engaging a top surface of a flooring board, and a forward workpiece engaging surface for engaging a front surface of the flooring board. One of the bottom workpiece engaging surface and the forward workpiece engaging surface is movable with respect to the other to adjust a distance that the forward workpiece engaging surface extends below the bottom workpiece engaging surface.

It is also an aspect of the present invention to provide a method for adjusting a fastener driving device for driving fasteners into flooring boards of different thicknesses.

In an embodiment a method for adjusting a fastener driving device for driving fasteners into flooring boards of different thicknesses is provided. The fastener driving device includes a bottom workpiece engaging surface for engaging a top surface of a flooring board and a forward workpiece engaging surface for engaging a front surface of the flooring board. The method includes moving one of the bottom workpiece engaging surface and the forward workpiece engaging surface with respect to the other to adjust a distance that the forward workpiece engaging surface extends below the bottom workpiece engaging surface, and subsequently preventing the bottom workpiece engaging surface from moving relative to the forward workpiece engaging surface.

It is an aspect of the present invention to provide a fastener driving device that can be used to fasten flooring boards to a sub-floor without the risk of damaging the flooring boards over time.

In an embodiment, a fastener driving device for fastening flooring boards to a sub-floor is provided. Each flooring board has a top surface, a tongue, and a front surface connecting the top surface and the tongue. The device includes a housing containing an engine for driving a fastener through the flooring board and into the sub-floor, a nosepiece through which fasteners are driven, a magazine for supplying a plurality of fasteners for the engine to drive, and a shoe mounted to the housing. The shoe includes a bottom workpiece engaging surface that is configured to engage the top surface of the flooring board and locate the engine relative to the flooring board so that the fastener is driven into the flooring board at an angle. The shoe is mounted to the housing without the use of a fastener passing through the bottom workpiece engaging surface.

Other aspects, features, and advantages of the present invention will become apparent from the following detailed description, the accompanying drawings, and the appended claims.

BRIEF DESCRIPTION OF THE DRAWINGS

Features of the invention are shown in the drawings, in which like reference numerals designate like elements. The drawings form part of this original disclosure, in which.

DETAILED DESCRIPTION OF THE INVENTION

Figure 1:
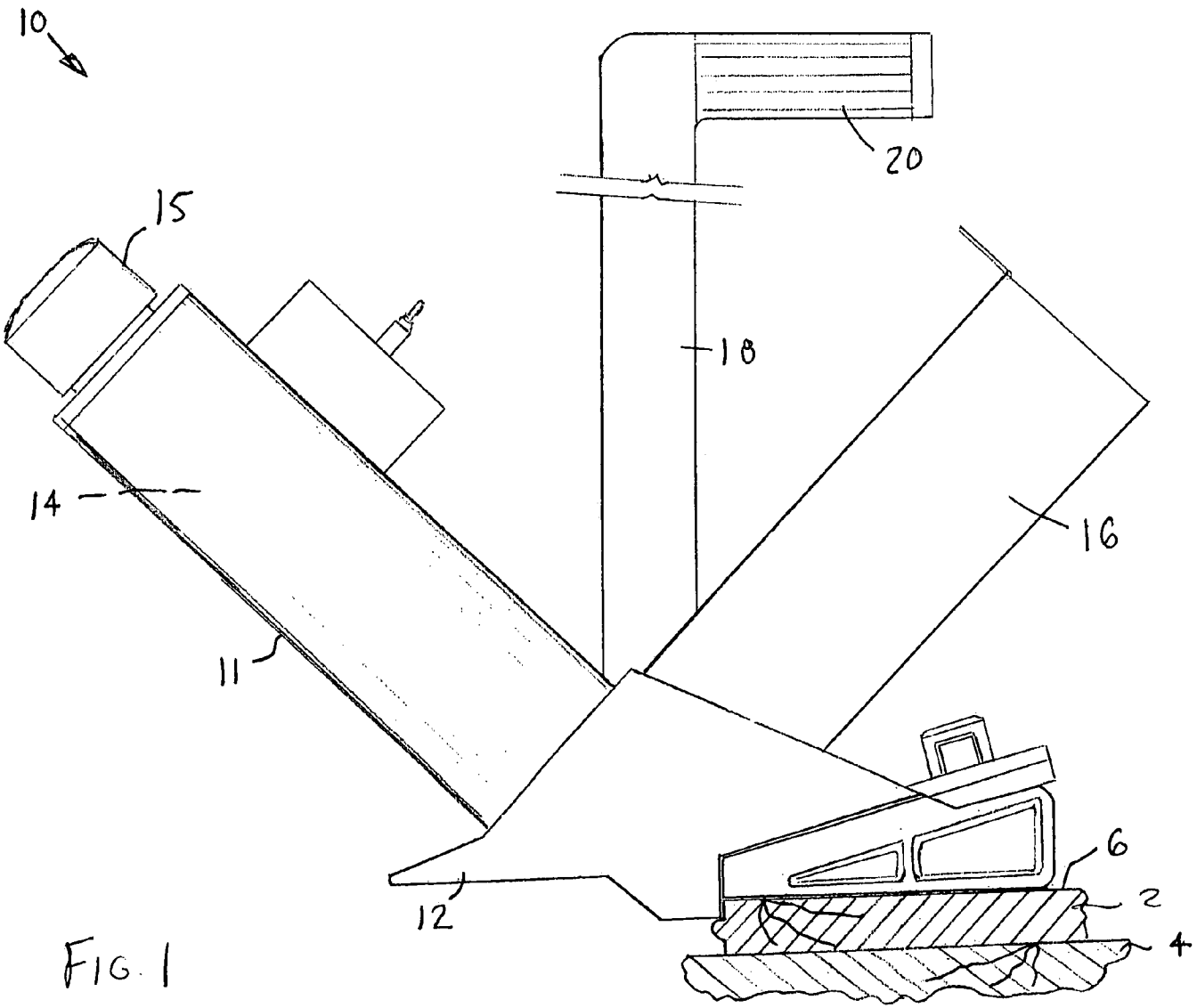
FIG. 1 is a side view of an embodiment of a fastener driving device of the present invention.
Figure 2:
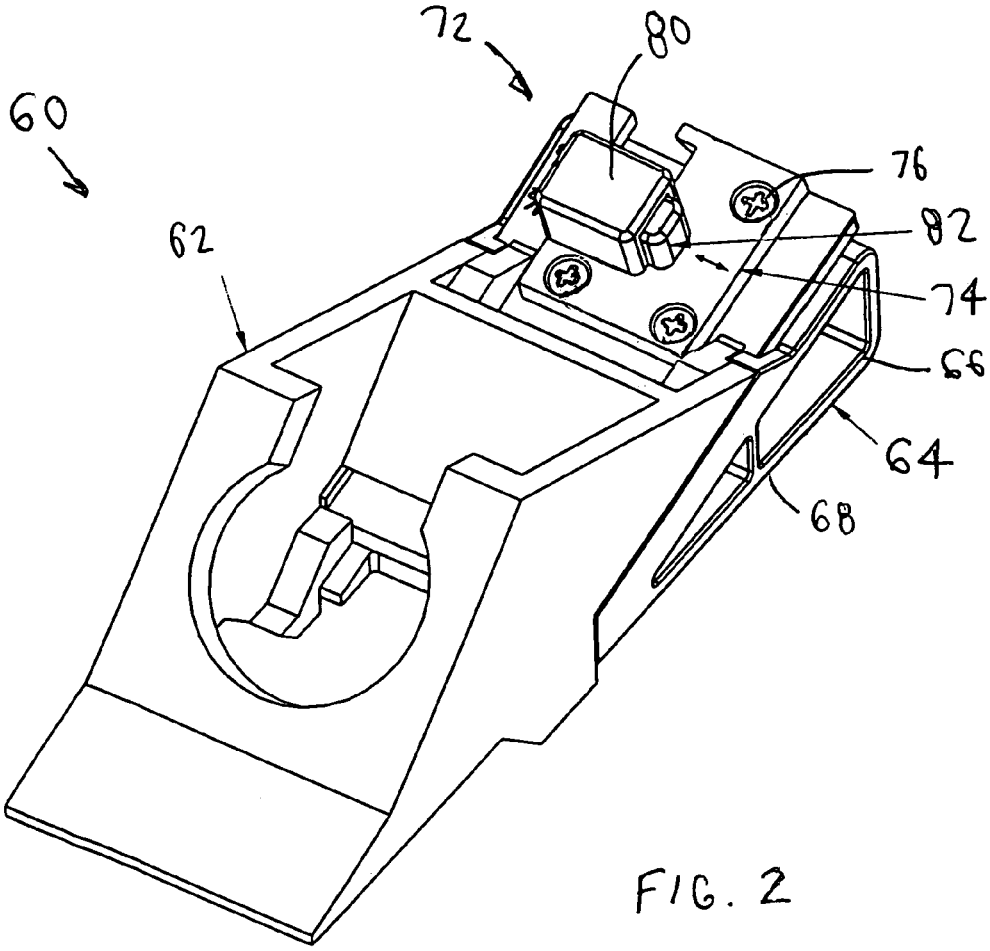
FIG. 2 is a perspective view of an embodiment of a shoe of a fastener driving device of the present invention.
Figure 3:
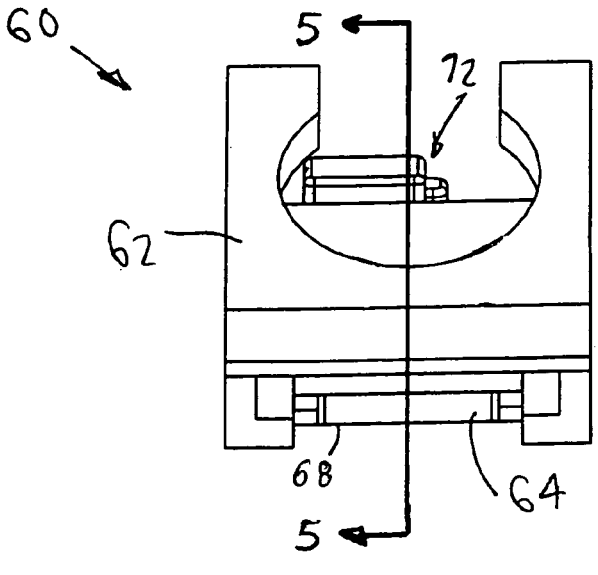
FIG. 3 is a front view of the shoe of FIG. 2.
Figure 4:
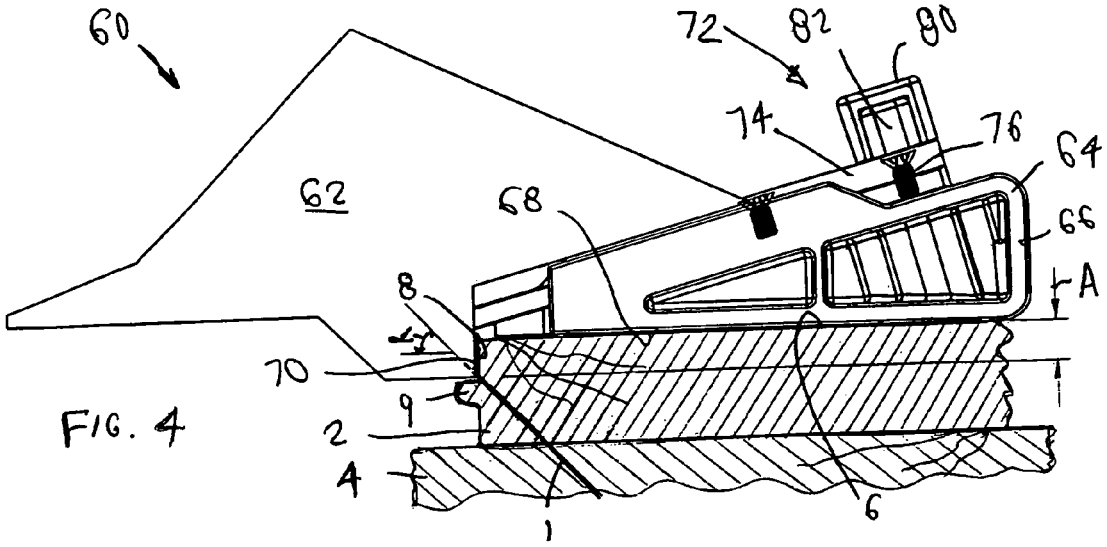
FIG. 4 is a side view of the shoe of FIG. 2 as it rests on a flooring board, with a movable portion of the shoe in a first position.
Figure 5:
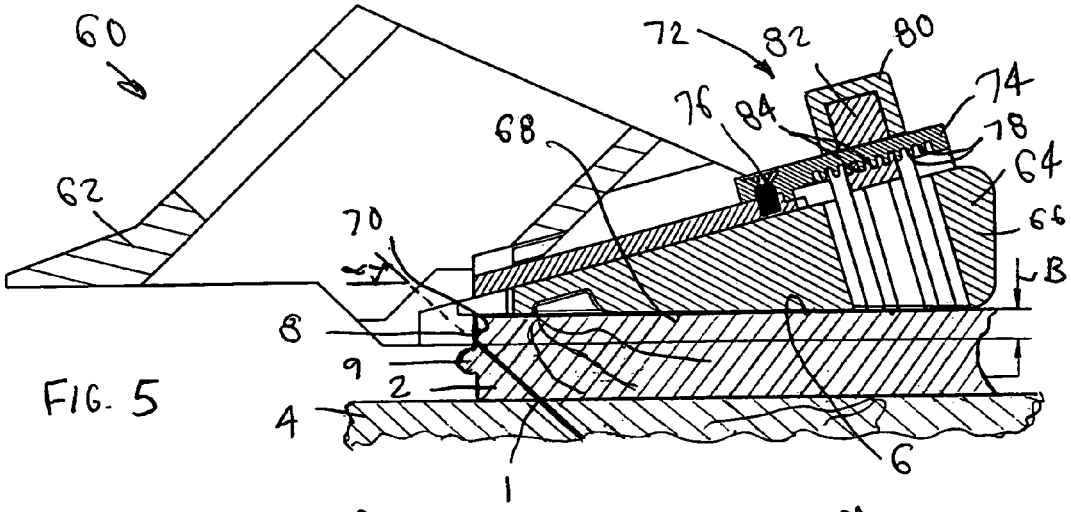
FIG. 5 is a cross-sectional view of the shoe taken along line 5-5 in FIG. 3 as the shoe rests on a flooring board, with the movable portion of the shoe in a second position.
Figure 6:
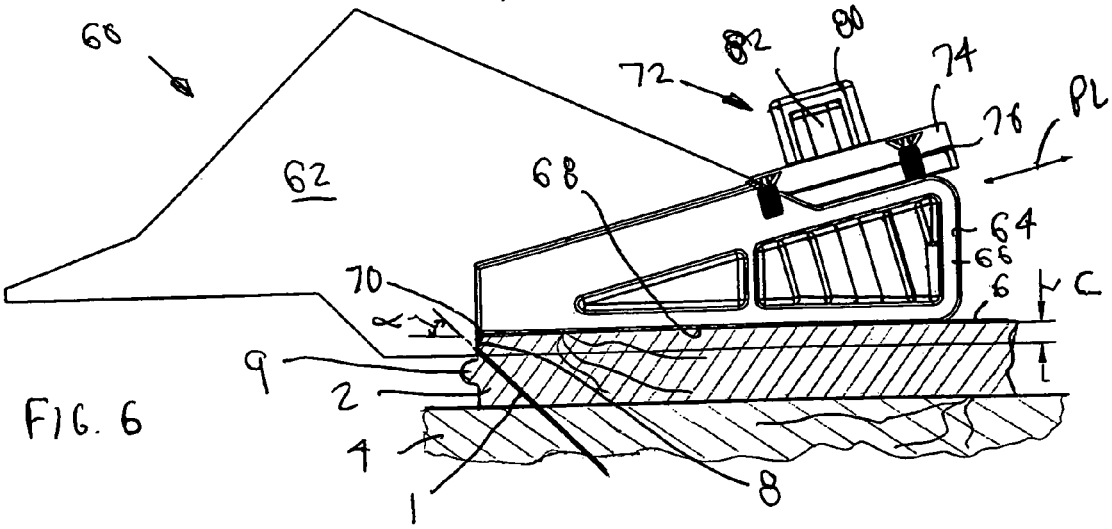
FIG. 6 is a side view of the shoe of FIG. 2 as it rests on a flooring board, with the movable portion of the shoe in a third position.
Figure 7:
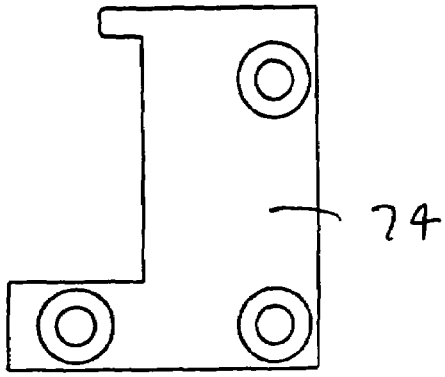
FIG. 7 is top view of an indexing plate of a lock of the shoe of FIG. 2.

A fastener driving device 10 for fastening a flooring board 2 to a sub-floor 4 in accordance with an embodiment of the invention is shown in FIG. 1. The device 10 includes a housing 11, a shoe 12 connected to the housing 11, an engine 14 contained within the housing 11, a nose connected to the housing 11 through which fasteners are driven, a magazine 16 that is connected to the nose, and a handle 18 that is connected to the shoe 12 at one end thereof. The device 10 may also be referred to as a tool, a nailer, a flooring tool, or a flooring nailer. The shoe 12 will be discussed in further detail below, but is generally configured to rest on a top surface 6 of at least one flooring board 2 so that a fastener 1 may be driven through the flooring board 2 by the engine 14 at an angle $\alpha$, and into a sub-floor 4, as shown in FIGS. 4-6.

The engine 14 may be of any type of engine 14 that is used in flooring nailers. For example, the engine 14 may be of a manually actuated type that converts energy provided by the user into energy that drives the fastener. Such engines 14 are described in, for example, U.S. Pat. No. 3,281,046, which is incorporated herein by reference. The engine 14 may also be of a pneumatic type that uses compressed gas, such as air, to power the engine 14 to drive the fastener upon actuation of an actuator 15, such as the actuator shown in FIG. 1. An example of a pneumatic engine for a flooring tool is described in, for example, U.S. Pat. No. 3,542,273, which is incorporated herein by reference. Because the specific internal design of the engine 14 is not related to the features of the present invention, the internal design of the engine 14 is not discussed further.

The magazine 16 may include a spring biased pusher that is configured to supply a plurality of fasteners to the nose so that the engine 14 may drive the fasteners, one by one, into the flooring board 2. The fasteners may be staples, cleats, wire nails, or any other type of fastener that may be used to secure the flooring board 2 to the sub-floor 4.

The handle 18 includes a grip 20 at an end that is opposite the end that is connected to the shoe 12. The grip 20 is configured to be grasped by a user's hand. The grip 20 may be of any shape, but is preferably shaped so that it is relatively easy for a person to firmly grasp and hold the device 10. The grip 20 may be molded from plastic or rubber and may be attached to the handle 18 with fasteners, such as screws. Alternatively, the grip 20 may be press fit or even insert molded onto a portion of the handle. It is also contemplated that the grip 20 may be an integral part of the handle 18. The illustrated embodiments should not be considered to be limiting in any way.

FIGS. 2-15 illustrate an embodiment of a shoe 60 that may be included in the device 10 discussed above. The shoe 60 may be the same as the shoe 12 shown in FIG. 1, or it may be of a different design. As shown in FIGS. 2-6, 14, and 15, the shoe 60 includes an adjustment mechanism that includes a fixed portion 62 and a movable portion 64. As illustrated, the movable portion 64 includes a wedge shaped body 66, as will be discussed in greater detail below, that includes a bottom workpiece engaging surface 68. The bottom workpiece engaging surface 68 is configured to rest on the top surface 6 of the flooring board 2 when the device 10 is being used. The movable portion 64 may be molded from a plastic material, such a nylon, so that it does not damage the top surface 6 of the flooring boards 2 when the device 10 is used. Of course, any material may be used, so long as it does not damage the top surface 6 of the flooring board 2.

The fixed portion 62 includes a forward workpiece engaging surface 70 that is configured to engage a front surface 8 of the flooring board 2. The forward workpiece engaging surface 70 is preferably substantially perpendicular to the bottom workpiece engaging surface 68. As shown in FIGS. 4-6, the front surface 8 of the flooring board 2 is the surface that connects a tongue 9 of the flooring board 2 with the top surface 6. The size of the front surface 8, i.e., the vertical distance between the tongue 9 and the top surface 6, varies with the size of the flooring board 2. For example, the front surface 8 will be smaller on a ½ inch (nominal thickness) flooring board as compared to the front surface 8 on a 33/32 inch (nominal thickness) flooring board.

Thus, to accommodate different sizes of flooring boards 2 with the same device 10, and to properly locate fasteners 1 being driven from the engine 14 into the flooring boards 2 of different sizes at the proper angle $\alpha$, the movable portion 64 of the shoe 60 is movable so that exposure of the forward workpiece engaging surface 70 may be adjusted between a minimum exposure and a maximum exposure. The exposure of the forward workpiece engaging surface 70 is generally defined as the height of the exposed forward workpiece engaging surface 70 that is below the bottom workpiece engaging surface 68, and is available to engage the front surface 8 of the flooring board 2. It is understood the "below" the bottom workpiece engaging surface 68 does not necessarily mean directly below, but generally means that the forward workpiece engaging surface 70 is below a plane that includes the bottom workpiece engaging surface 68, as shown in the figures.

For example, the flooring board 2 shown in FIG. 4 may have a nominal thickness of about ¾ inch, while the flooring board 2 shown in FIG. 6 may have a nominal thickness of about ½ inch, and the flooring board 2 shown in FIG. 5 may have a thickness in between ½ inch and ¾ inch. However, even though the size of the front surface 8 of these three different sized flooring boards 2 varies, as indicated by A, B, and C in FIGS. 4, 5, and 6, respectively, the location of the fastener 1 relative to the tongue 9 does not vary due to the adjustability of the shoe 60, and change in the exposure of the forward workpiece engaging surface. A, B, and C also corresponds with the exposure of the forward workpiece engaging surface 70, as it is described above. For example, A may be about 0.45 inch, or greater, C may be about 0.20 inch, and B may be between about 0.20 inch and 0.45 inch. The illustrated embodiment is not intended to be limiting in any way. For example, A may be about 0.60 inch, or even greater, and C may be about 0.10 inch, or even smaller, depending on the thickness of the board.

In another embodiment (not shown), the forward workpiece engaging surface is carried by a moveable portion of the shoe, and the bottom workpiece engaging surface is located on a fixed portion of the shoe. Any structural arrangement is contemplated, as long as the exposure of the forward workpiece engaging surface is adjustable between the minimum exposure and the maximum exposure.

Figure 8:
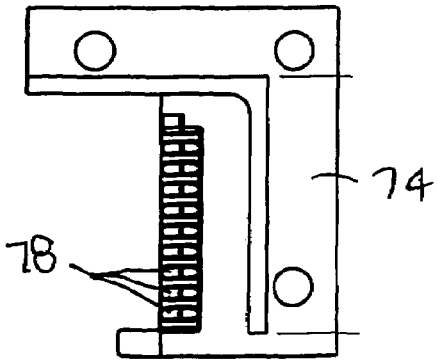
FIG. 8 is a bottom view of the indexing plate of FIG. 7.
Figure 9:
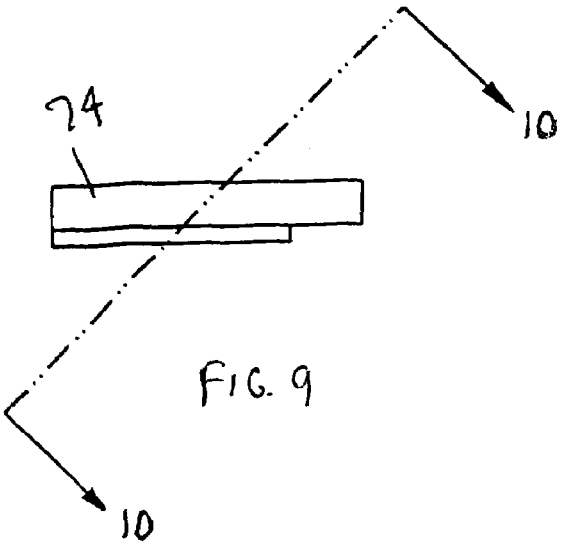
FIG. 9 is a side view of the indexing plate of FIG. 7.
Figure 10:
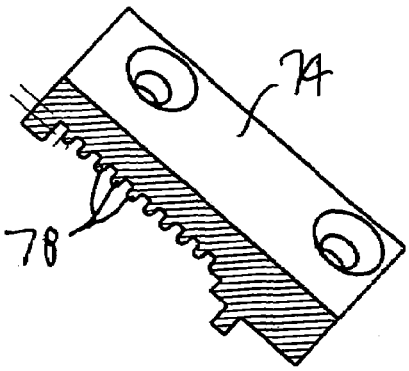
FIG. 10 is a cross-sectional view of the indexing plate taken along line 10-10 in FIG. 9.

In the illustrated embodiment, the shoe 60 also includes a lock 72 that locks the movable portion 64 into a pre-selected position, such as one of the positions shown in FIGS. 4-6. The lock 72 includes an indexing plate 74 that may be attached to the fixed portion 62 of the shoe with a plurality of fasteners 76. As shown in FIGS. 5, 8, and 10, the plate 74 includes a plurality of teeth 78 that provide the indexed positions. Details of the indexing plate 74 are shown in FIGS. 7-10.

Figure 13:
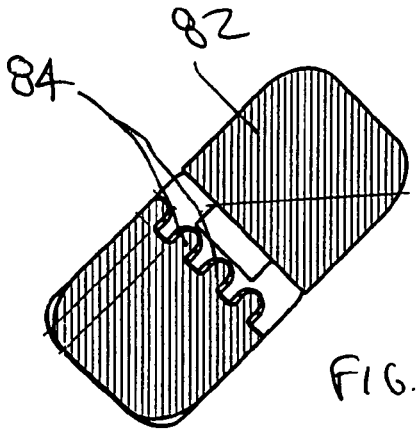
FIG. 13 is a cross-sectional view of the engaging member taken along line 13-13 in FIG. 11.
Figure 12:
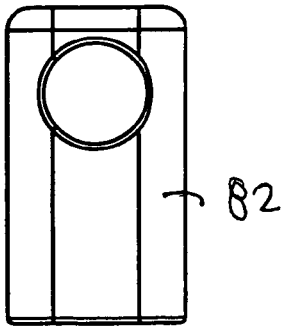
FIG. 12 is a rear view of the engaging member of FIG. 11.
Figure 11:
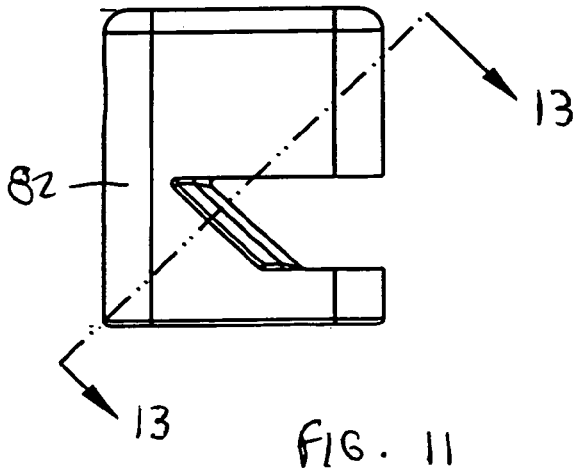
FIG. 11 is side view of an engaging member of the lock of the shoe of FIG. 2.
Figure 14:
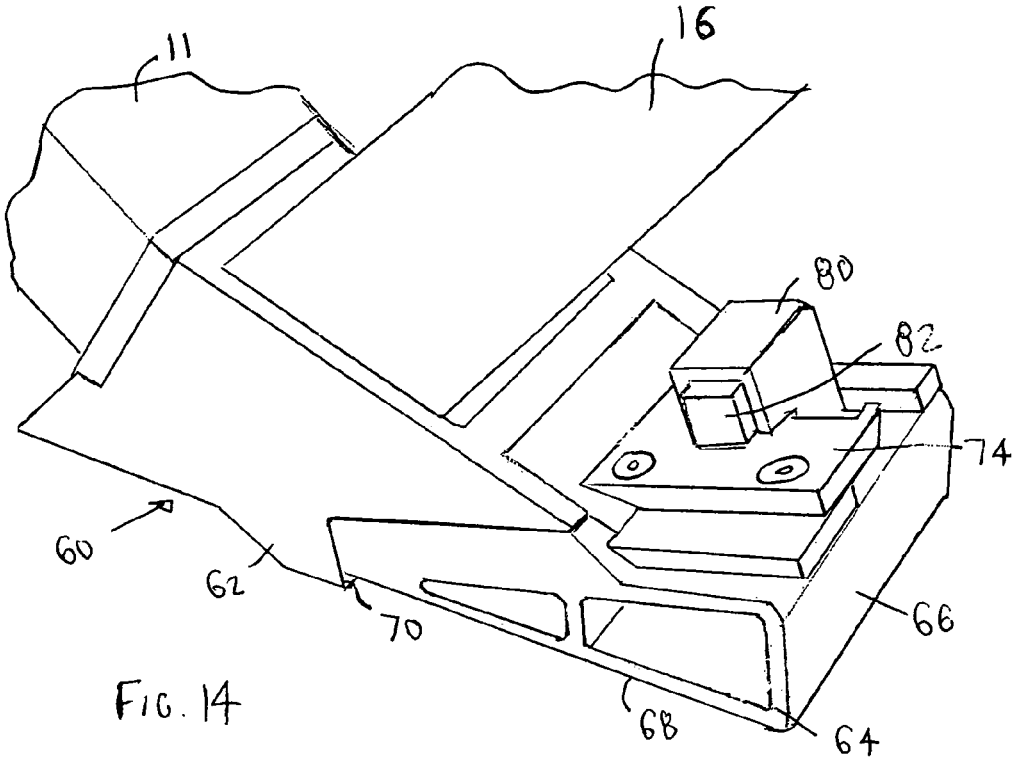
FIG. 14 is a perspective view of the shoe of FIG. 2, attached to the fastener driving device, with the movable portion in the third position.
Figure 15:
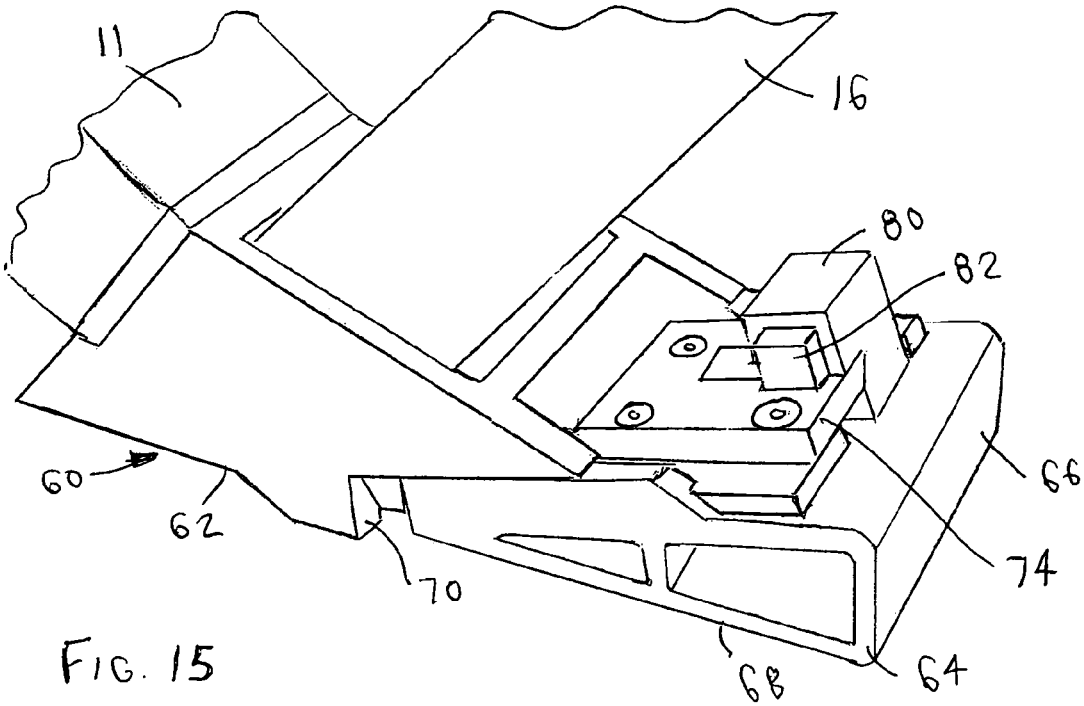
FIG. 15 is a perspective view of the shoe of FIG. 14, with the movable portion in the first position.

The lock 72 further includes a protrusion 80 that extends from a top side of the wedge shaped body 66, as shown in FIGS. 14 and 15. The protrusion 80 is configured to receive an engaging member 82 that may be received by a user's thumb or finger to press the engaging member 82 inward and into the protrusion 80 against a bias of a biasing member, such as a spring. Details of the engaging member 82 are shown in FIGS. 11-13. As shown in FIGS. 5 and 13, the engaging member 82 includes a plurality of teeth 84 that are constructed and arranged to engage with the plurality of teeth 78 on the indexing plate 74 when the engaging member 82 is biased by the biasing member. This way, the movable portion 64 may be fixedly secured to the fixed portion 62 when the fastener driving device 10 is in use.

To adjust the height of the surface 70 of the fixed portion 62 for thicker or thinner flooring boards 2, the user simply pushes the engaging member 82 against the bias of the biasing member until the teeth 84 of the engaging member 82 disengage from the teeth 78 on the indexing plate 74, thereby allowing the wedge shaped body 66 to be moved along a plane PL, shown in FIG. 6. The indexing plate 74 and/or the fixed portion 62 may also include a gauge that indicates to the user what setting should be used for a flooring board 2 of a particular thickness. When the wedge shaped body 66 is located at the desired location, the user simply releases the engaging member 82 until the teeth 84 on the engaging member 82 re-engage with the teeth 78 on the indexing plate 74, thereby fixedly securing the movable portion 64 once again. The illustrated embodiment of the lock 72 is not intended to be limiting in any way.

Figure 16:
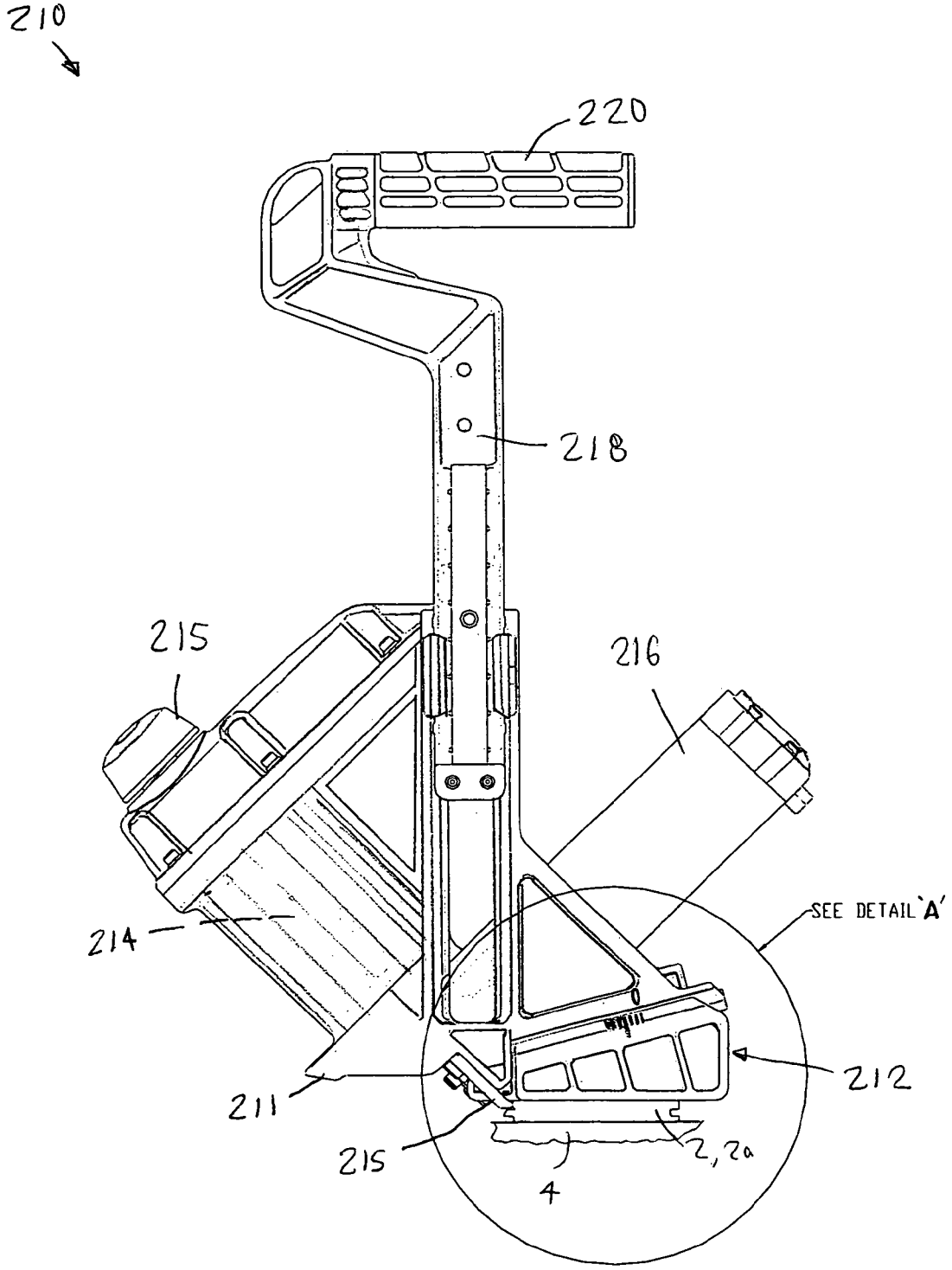
FIG. 16 is a side view of another embodiment of a fastener driving device of the present invention with a shoe in a first position.
Figure 17:
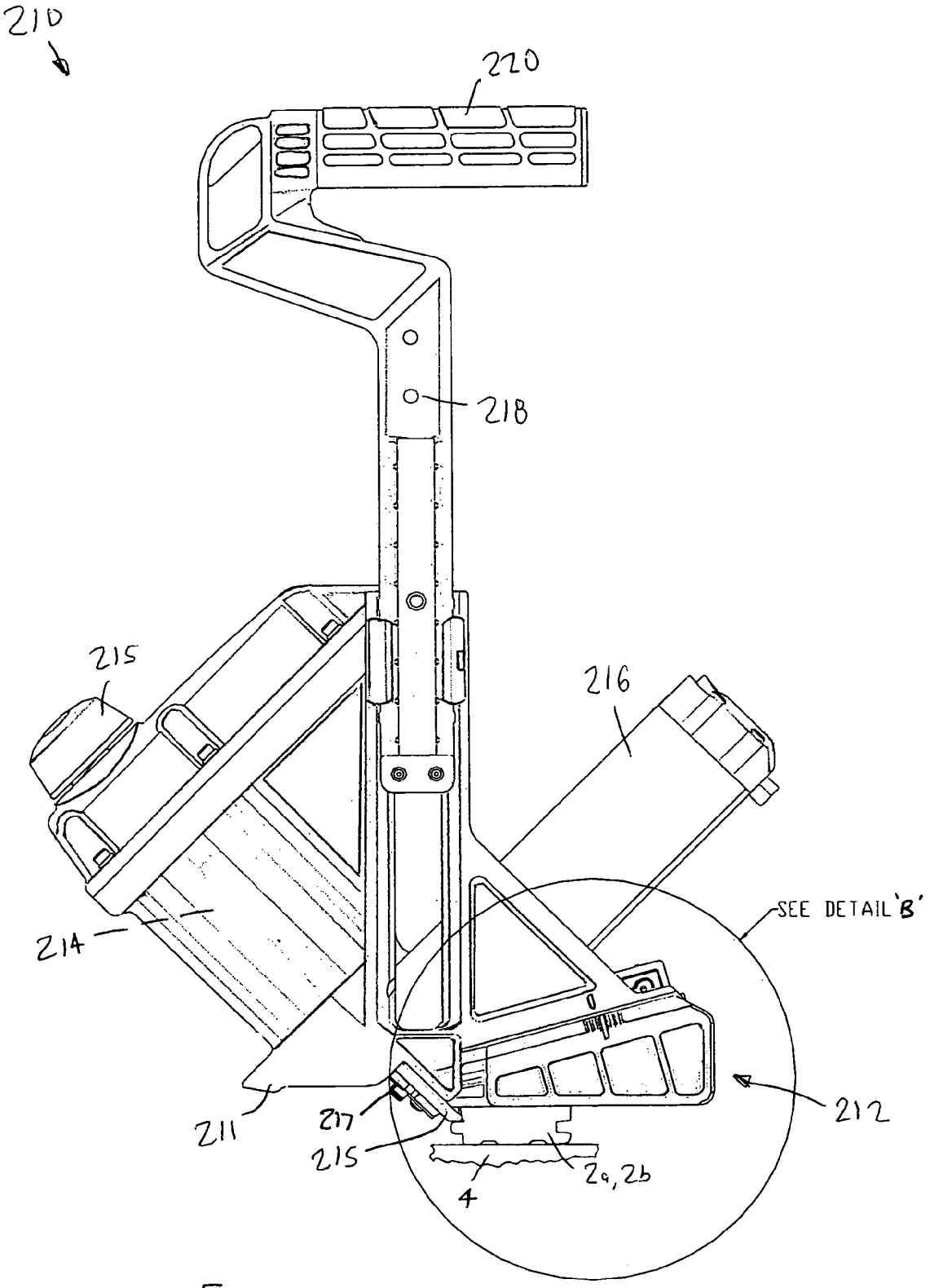
FIG. 17 is a side view of the fastener driving device of the present invention with the shoe in a second position.

FIGS. 16-20 illustrate another embodiment of a fastener driving device 210 according to the present invention. As shown in FIGS. 16 and 17, the device 210 includes a housing, or frame, 211, a shoe 212 connected to the housing 211, an engine 214 contained within the housing 211, a nosepiece 215 connected to the housing 211 through which fasteners are driven, a magazine 216 that is connected to the housing 211, and a handle 218 that is connected to the housing 211 at one end thereof. Like the device 10 described above, the device 210 may also be referred to as a tool, a nailer, a flooring tool, or a flooring nailer. The shoe 212 will be discussed in further detail below, but, like the shoes 12, 60 described above, is generally configured to rest on a top surface 6 of at least one flooring board 2 so that a fastener may be driven through the flooring board 2 by the engine 214 at an angle α, and into a sub-floor 4, as shown in FIGS. 4-6.

The engine 214 may be of any type of engine 214 that is used in flooring nailers. For example, like the engine 14 described above, the engine 214 may be of a manually actuated type that converts energy provided by the user into energy that drives the fastener. The engine 214 may also be of a pneumatic type that uses compressed gas, such as air, to power the engine 214 to drive the fastener upon actuation of an actuator 215, such as the actuator shown in FIGS. 16 and 17. Because the specific internal design of the engine 214 is not related to the features of the present invention, the internal design of the engine 214 is not discussed further.

The nosepiece 215 defines a drive track therein. The fasteners are driven out of the drive track by a driver that is associated with the engine 214. As shown, the nosepiece 215 is attached to the housing 211 with at least one fastener 217. It is also contemplated that the nosepiece 215 may be integrally formed with the housing 211. The illustrated embodiment is not intended to be limiting in any way.

The magazine 216 may include a spring biased pusher that is configured to supply a plurality of fasteners to the nosepiece 215 so that the engine 214 may drive the fasteners, one by one, into the flooring board 2. As discussed above, the fasteners may be staples, cleats, wire nails, or any other type of fastener that may be used to secure the flooring board 2 to the sub-floor 4.

The handle 218 includes a grip 220 at an end that is opposite the end that is received by the housing 211. The grip 220 is configured to be grasped by a user's hand. The grip 220 may be of any shape, but is preferably shaped so that it is relatively easy for a person to firmly grasp and hold the device 210. The grip 220 may be molded from plastic or rubber and may be attached to the handle 218 with fasteners, such as screws. Alternatively, the grip 220 may be press fit or even insert molded onto a portion of the handle. It is also contemplated that the grip 220 may be an integral part of the handle 218. The illustrated embodiments should not be considered to be limiting in any way.

Figure 18:
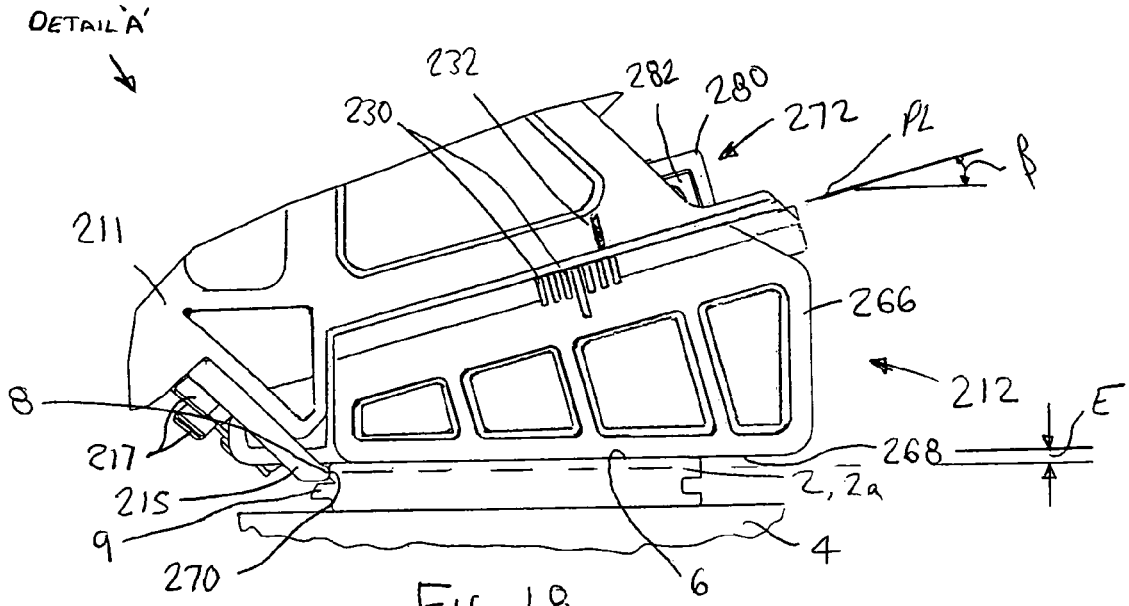
FIG. 18 is a closer view of Detail 'A' in FIG. 16.
Figure 19:
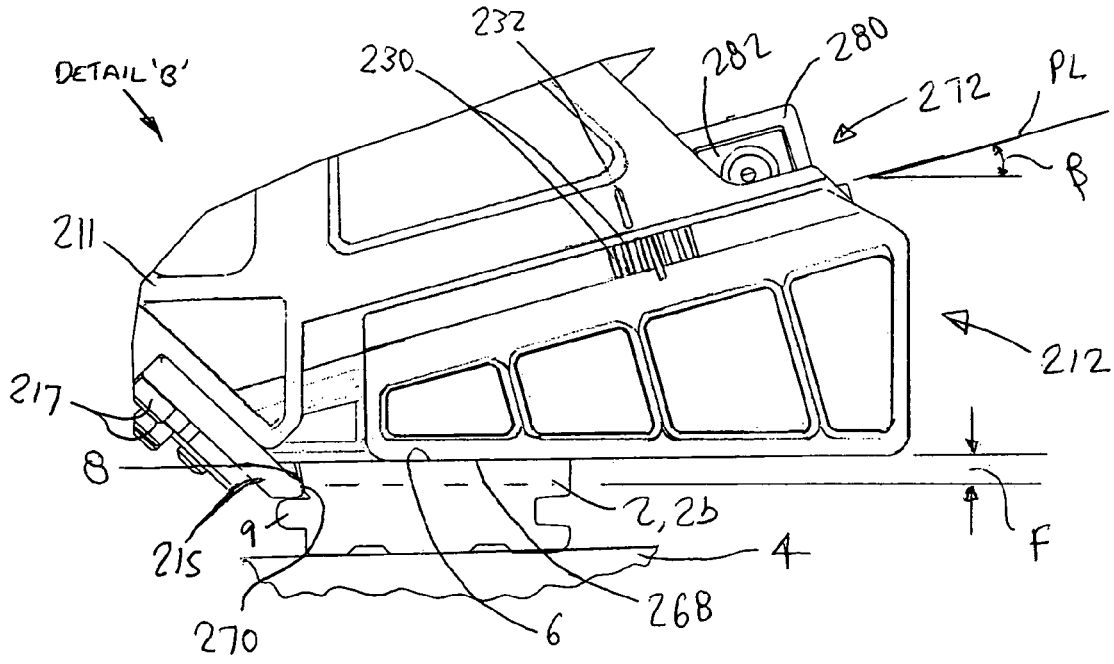
FIG. 19 is a closer view of Detail 'B' in FIG. 17.

As shown in FIGS. 18 and 19, the shoe 212 is configured to be moveable relative to the housing 211 so as to provide an adjustment mechanism for the device 210, as will be discussed in further detail below. The shoe 212 includes a wedge shaped body 266, as will be discussed in greater detail below, that includes a bottom workpiece engaging surface 268. The bottom workpiece engaging surface 268 is configured to rest on the top surface 6 of the flooring board 2 when the device 210 is being used. The wedge shaped body 266 may be molded from a plastic material, such a nylon, so that it does not damage the top surface 6 of the flooring boards 2 when the device 210 is used. Of course, any material may be used, so long as it does not damage the top surface 6 of the flooring board 2.

The nosepiece 215 includes a forward workpiece engaging surface 270 that is configured to engage a front surface 8 of the flooring board 2. As shown in FIGS. 18 and 19, the front surface 8 of the flooring board 2 is the surface that connects a tongue 9 of the flooring board 2 with the top surface 6. As discussed above, the size of the front surface 8, i.e., the vertical distance between the tongue 9 and the top surface 6, varies with the size of the flooring board 2.

Thus, to accommodate different sizes of flooring boards 2 with the same device 210, and to properly locate fasteners into the flooring boards 2 of different sizes at the proper angle, the shoe 212, more specifically the wedge shaped body 266, is movable so that a distance that the forward workpiece engaging surface 270 extends below the bottom workpiece engaging surface 268 of the shoe 212 may be adjusted between a minimum distance and a maximum distance. It is understood the "below" the bottom workpiece engaging surface 268 does not necessarily mean directly below, but generally means that the forward workpiece engaging surface 270 is below a plane that includes the bottom workpiece engaging surface 268, as shown in the figures. In an embodiment, the flooring board 2 shown in FIG. 18 may have a nominal thickness of about ½ inch, while the flooring board 2 shown in FIG. 19 may have a nominal thickness of about 25/32 inch. However, even though the size of the front surface 8 of these different sized flooring boards 2 varies, the location of the fastener relative to the tongue 9 does not vary due to the adjustability of the shoe 212.

For example, when a thinner flooring board 2*a* is being fastened to the sub-floor 4, as shown in FIG. 18, the distance E that the forward workpiece engaging surface 270 of the nosepiece 215 extends below the bottom workpiece engaging surface 268 of the shoe 212 may be about 0.10 inch. When a thicker flooring board 2*b* is being fastened to the sub-floor 4, as shown in FIG. 19, the distance F that the forward workpiece engaging surface 270 of the nosepiece 215 extends below the bottom workpiece engaging surface 268 of the shoe 212 may be about 0.25 inch. These values should be considered to represent examples of the distance between the forward workpiece engaging surface 270 and the bottom workpiece engaging surface 268, and are not intended to be limiting in any way. For example, it is contemplated that the distance F may be about 0.60 inch or even greater, depending on the thickness of the board.

Figure 20:
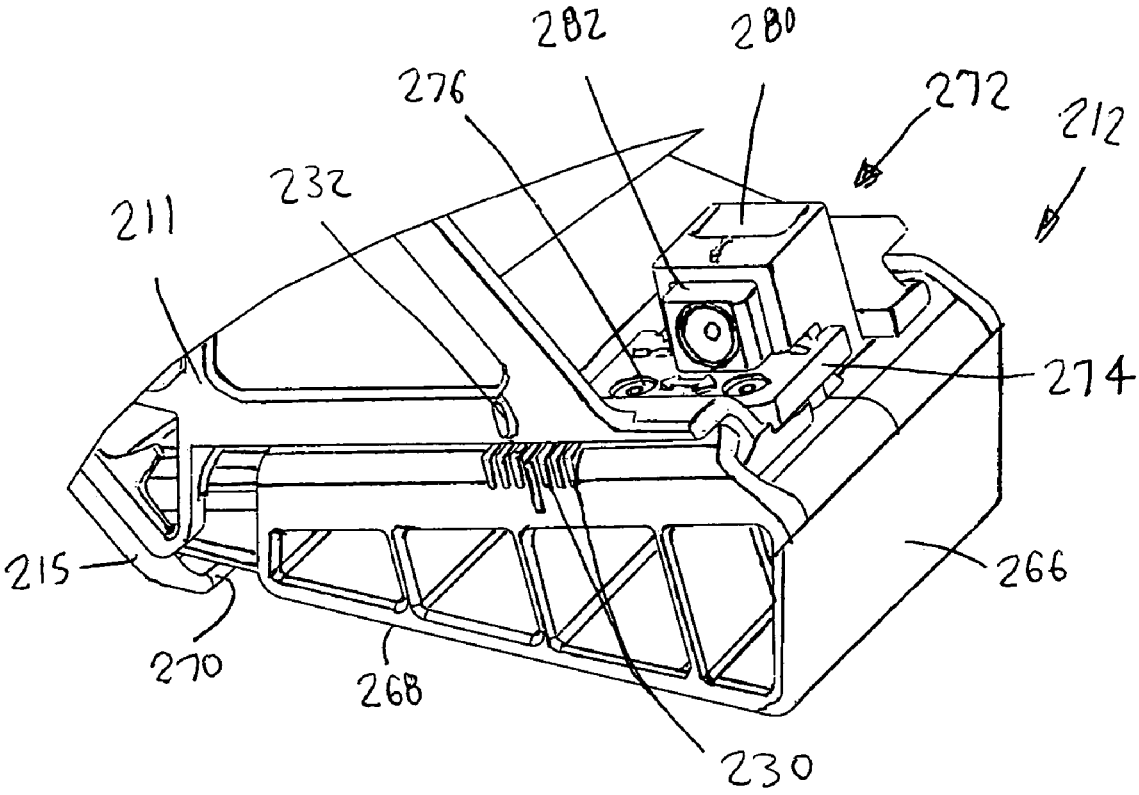
FIG. 20 is a rear perspective view of the shoe of FIG. 19.

The device 210 also includes a lock 272 that locks the shoe 212 into a pre-selected position, such as one of the positions shown in FIGS. 18 and 19. The lock 272 may be substantially the same as the embodiment of the lock 72 described above. For example, as shown in FIG. 20, the lock 272 includes an indexing plate 274 that may be attached to the housing 211 with a plurality of fasteners 276. The plate 274 may be substantially the same as the plate 74, the details of which are shown in FIGS. 7-10, and described above.

The lock 272 further includes a protrusion 280 that extends from a top side of the wedge shaped body 266, as shown in FIG. 18-20. The protrusion 280 is configured to receive an engaging member 282 that may be received by a user's thumb or finger to press the engaging member 282 inward and into the protrusion 280 against a bias of a biasing member, such as a spring. The engaging member 282 may be substantially the same as the engaging member 82, the details of which are in FIGS. 11-13. The engaging member 282 includes a plurality of teeth that are constructed and arranged to engage with a plurality of teeth on the indexing plate 274 when the engaging member 282 is biased by the biasing member.

To adjust the distance between the forward workpiece engaging surface 272 located on the nosepiece 215 and the bottom workpiece engaging surface 268 on the shoe 212, for thicker or thinner flooring boards 2, the user simply pushes the engaging member 282 against the bias of the biasing member until the teeth of the engaging member 282 disengage from the teeth on the indexing plate 274, thereby allowing the wedge shaped body 266 to be moved along a plane PL, shown in FIGS. 18 and 19. When the wedge shaped body 266 is located at the desired location, the user simply releases the engaging member 282 until the teeth on the engaging member 282 re-engage with the teeth on the indexing plate 274, thereby fixedly securing the shoe 212 once again. The illustrated embodiment of the lock 272 is not intended to be limiting in any way.

As shown in FIGS. 18 and 19, the shoe 212 may include a plurality of indicia 230 that are spaced apart so in a gauge-like arrangement, and a single indicator 232 may be provided on the housing 211 so that the user may have an easy way to set the position of the shoe 212 from job to job. The indicia 230 are preferably spaced apart at the same distance, or a multiple thereof, as the distance between the plurality of teeth on the indexing plate 274. This allows the user to have tactile and/or visual feedback when adjusting the position of the shoe 212 relative to the housing 211.

As shown in FIGS. 18 and 19, an angle β is defined by the bottom workpiece engaging surface 268 of the shoe 212 and the plane PL along which the shoe 212 translates when it is moved between positions. Preferably, the angle β is less than 45°. More preferably, the angle β is between about 10° and about 30°. Most preferably, the angle β is about 15°. By providing an acute angle that is less than 45°, the movement of the shoe 212 along the plane PL by a single unit will translate into the change of the distance between the forward workpiece engaging surface 270 and the bottom workpiece engaging surface 268 by a value that is less than the single unit. The smaller the angle β, the smaller the change in the distance between the forward workpiece engaging surface 270 and the bottom workpiece engaging surface 268 when the shoe 212 is moved along the plane PL. This allows for more precise movement of the bottom workpiece engaging surface 268 relative to the forward workpiece engaging surface 270 without having to have such precise movement of the shoe 212 along the plane PL.

It has been found that by connecting the shoe 212 to the housing 211 from a location that is above and away from the bottom workpiece engaging surface 268, there is essentially no risk of damaging the flooring over time. This is because embodiments of the present invention allow the bottom workpiece engaging surface 268 of the shoe 212 to be connected to the housing 211 via the lock 272, without the use of fasteners that pass through the bottom workpiece engaging surface 268. The bottom workpiece engaging surface 268 is preferably substantially continuous. Although the bottom workpiece engaging surface 268 may not be completely continuous (e.g., indentations and/or small holes may be present as a result of the manufacturing procees), no fasteners pass through the surface 268. As such, there is no risk of such fasteners extending past the bottom workpiece engaging surface 268 over time and potentially damaging the flooring.

All of the various features and mechanisms described with respect to the specific embodiments may be interchanged with the various embodiments described, or may be used with other variations or embodiments.

The foregoing illustrated embodiments have been provided solely for illustrating the structural and functional principles of the present invention and are not intended to be limiting. To the contrary, the present invention is intended to encompass all modifications, alterations, substitutions, and equivalents within the spirit and scope of the following claims.

What is claimed is:

1. A fastener driving device for fastening flooring boards to a sub-floor, each flooring board having a top surface, a tongue, and a front surface connecting the top surface and the tongue, the device comprising:

a housing containing an engine for driving a fastener through the flooring board and into the sub-floor;

a magazine for supplying a plurality of fasteners for the engine to drive;

a handle for receiving a user's hand; and a shoe connected to the housing, the shoe being configured to locate the engine relative to the flooring board so that the fastener is driven into the flooring board at an angle, wherein the shoe comprises a bottom workpiece engaging surface for engaging the top surface of the flooring board, and a workpiece engaging surface for engaging the front surface of the flooring board, and wherein the shoe is configured to provide relative movement between the bottom workpiece engaging surface and the forward workpiece engaging surface while the shoe remains connected to the housing to adjust an exposure of the forward workpiece engaging surface to accommodate different thicknesses of the flooring boards, the exposure being the height of the forward workpiece engaging surface that is below a plane that includes the bottom workpiece engaging surface.

2. A fastener driving device according to claim 1, wherein the shoe comprises a fixed portion and a movable portion that is movable relative to the fixed portion.

3. A fastener driving device according to claim 2, wherein the movable portion comprises a wedge shaped body that is movable along a plane at a second angle relative to the bottom workpiece engaging surface.

4. A fastener driving device according to claim 2, wherein the fixed portion of the shoe comprises the forward workpiece engaging surface and the movable portion of the shoe comprises the bottom workpiece engaging surface.

5. A fastener driving device according to claim 2, wherein the shoe further comprises a lock for locking the movable portion relative to the fixed portion.

6. A fastener driving device according to claim 5, wherein the lock comprises a first plurality of teeth located on the fixed portion of the shoe that are configured to engage and a second plurality of teeth located on the movable portion of the shoe to lock the movable portion relative to the fixed portion.

7. A fastener driving device according to claim 6, wherein the second plurality of teeth are located on a member that is movable between a locked position and an unlocked position, the member being biased in the locked position that locks the movable portion of the shoe relative to the fixed portion of the shoe.

8. A fastener driving device according to claim 7, wherein the first and second pluralities of teeth index a position of the movable portion of the shoe.

9. A fastener driving device according to claim 1, wherein the exposure of the forward workpiece engaging portion is adjustable between a minimum exposure and a maximum exposure, and wherein the minimum exposure is about 0.10 inch.

10. A fastener driving device according to claim 1, wherein the exposure of the forward workpiece engaging portion is adjustable between a minimum exposure and a maximum exposure, and wherein the maximum exposure is about 0.60 inch.

11. A fastener driving device according to claim 1, wherein the engine is manually actuated and converts energy provided by the user into energy that drives the fastener.

12. A fastener driving device according to claim 1, wherein the engine is a pneumatic engine that uses a compressed gas to power the engine.

13. A shoe for coupling with a fastener driving device, the shoe being configured to locate an engine of the fastener driving device relative to a flooring board so that a fastener is driven into the flooring board at an angle, the flooring board comprising a top surface, a tongue, and a front surface that connects the top surface and the tongue, the shoe comprising:

a bottom workpiece engaging surface for engaging the top surface of the flooring board; and a forward workpiece engaging surface for engaging the front surface of the flooring board, wherein the shoe is configured to provide relative movement between the bottom workpiece engaging surface and the forward workpiece engaging surface to adjust an exposure of the forward workpiece engaging surface to accommodate different thicknesses of the flooring boards when the shoe is coupled to the fastener driving device, the exposure being the height of the forward workpiece engaging surface that is below a plane that includes the bottom workpiece engaging surface.

14. A shoe according to claim 13, wherein the shoe comprises a fixed portion and a movable portion that is movable relative to the fixed portion.

15. A shoe according to claim 14, wherein the movable portion comprises a wedge shaped body that is movable along a plane at a second angle relative to the bottom workpiece engaging surface.

16. A shoe according to claim 14, wherein the fixed portion of the shoe comprises the forward workpiece engaging surface and the movable portion of the shoe comprises the bottom workpiece engaging surface.

17. A shoe according to claim 16, wherein the shoe further comprises a lock for locking the movable portion relative to the fixed portion.

18. A shoe according to claim 17, wherein the lock comprises a first plurality of teeth located on the fixed portion of the shoe that are configured to engage and a second plurality of teeth located on the movable portion of the shoe to lock the movable portion relative to the fixed portion.

19. A shoe according to claim 18, wherein the second plurality of teeth are located on a member that is movable between a locked position and an unlocked position, the member being biased in the locked position that locks the movable portion of the shoe relative to the fixed portion of the shoe.

20. A shoe according to claim 19, wherein the first and second pluralities of teeth index a position of the movable portion of the shoe.

21. A shoe according to claim 13, wherein the exposure of the forward workpiece engaging portion is adjustable between a minimum exposure and a maximum exposure, and wherein the minimum exposure is about 0.10 inch.

22. A shoe according to claim 13, wherein the exposure of the forward workpiece engaging portion is adjustable between a minimum exposure and a maximum exposure, and wherein the maximum exposure is about 0.60 inch.

23. A fastener driving device for fastening flooring boards to a sub-floor, each flooring board having a top surface, a tongue, and a front surface connecting the top surface and the tongue, the device comprising:

a housing containing an engine for driving a fastener through the flooring board and into the sub-floor;

a nosepiece through which fasteners are driven;

a magazine for supplying a plurality of fasteners for the engine to drive;

a handle for receiving a user's hand; and a shoe mounted for movement relative to said nosepiece, the shoe being configured to locate the engine relative to the flooring board so that the fastener is driven into the front surface or the tongue of the flooring board at a non-zero angle relative to the front surface of the flooring board, wherein the shoe comprises a bottom workpiece engaging surface for engaging the top surface of the flooring board, and the nosepiece comprises a forward workpiece engaging surface for engaging the front surface of the flooring board, the forward workpiece engaging surface extending a distance below said bottom workpiece engaging surface, one of said bottom workpiece engaging surface and said forward workpiece engaging surface being movable with respect to the other to adjust the distance that the forward workpiece engaging surface extends below said bottom workpiece engaging surface.

24. A fastener driving device according to claim 23, wherein the shoe comprises a wedge shaped body that is movable along a plane at a second angle relative to the bottom workpiece engaging surface.

25. A fastener driving device according to claim 24, wherein the second angle is between about 10° and about 30°.

26. A fastener driving device according to claim 25, wherein the second angle is about 15°.

27. A fastener driving device according to claim 23, further comprising a lock for locking the shoe relative to the nosepiece.

28. A fastener driving device according to claim 27, wherein the lock comprises a first plurality of teeth located on the housing that are configured to engage a second plurality of teeth located on the shoe to lock the shoe relative to the housing.

29. A fastener driving device according to claim 28, wherein the second plurality of teeth are located on a member that is movable between a locked position and an unlocked position, the member being biased in the locked position that locks the shoe relative to the housing.

30. A fastener driving device according to claim 29, wherein the first and second pluralities of teeth index a position of the shoe.

31. A fastener driving device according to claim 23, wherein the distance is adjustable between a minimum distance and a maximum distance.

32. A fastener driving device according to claim 31, wherein the minimum distance is about 0.10 inch.

33. A fastener driving device according to claim 31, wherein the maximum distance is about 0.60 inch.

34. A fastener driving device according to claim 23, wherein the engine is manually actuated and converts energy provided by the user into energy that drives the fastener.

35. A fastener driving device according to claim 23, wherein the engine is a pneumatic engine that uses a compressed gas to power the engine.

* * * * *